US011330694B2

(12) United States Patent
Lin et al.

(10) Patent No.: US 11,330,694 B2
(45) Date of Patent: May 10, 2022

(54) PROGRAMMABLE LIGHT APPARATUS

(71) Applicant: XIAMEN ECO LIGHTING CO. LTD., Xiamen (CN)

(72) Inventors: Liping Lin, Xiamen (CN); Wenhui Yang, Xiamen (CN); Xinghan Lai, Xiamen (CN); Tian Lan, Xiamen (CN); Shuisheng Wen, Xiamen (CN); Xiaodeng Chen, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/671,735

(22) Filed: Nov. 1, 2019

(65) Prior Publication Data

US 2020/0178376 A1 Jun. 4, 2020

Related U.S. Application Data

(60) Provisional application No. 62/754,054, filed on Nov. 1, 2018.

(51) Int. Cl.

| | |
|---|---|
| ***H05B 45/10*** | (2020.01) |
| ***H05B 47/14*** | (2020.01) |
| ***H05B 47/19*** | (2020.01) |
| ***H05B 45/20*** | (2020.01) |
| ***H05B 45/325*** | (2020.01) |

(52) U.S. Cl.

CPC ..... *H05B 47/19* (2020.01); *H05B 45/10* (2020.01); *H05B 45/20* (2020.01); *H05B 45/325* (2020.01)

(58) Field of Classification Search

CPC ..... H05B 45/10; H05B 45/20; H05B 45/325; H05B 47/11; H05B 47/19; H05B 47/105; H05B 45/14; H05B 45/18; H05B 45/24; H05B 45/28; H05B 45/3577

See application file for complete search history.

(56) References Cited

U.S. PATENT DOCUMENTS

| | | | | |
|---|---|---|---|---|
| 9,801,250 | B1 * | 10/2017 | Halliwell | F21K 9/65 |
| 10,009,985 | B1 * | 6/2018 | Huang | H05B 45/20 |
| 2003/0058083 | A1 * | 3/2003 | Birchfield | G06F 1/1632 340/5.22 |
| 2008/0218317 | A1 * | 9/2008 | Choi | H05B 47/22 340/286.01 |
| 2016/0381768 | A1 * | 12/2016 | Noesner | H05B 47/19 315/153 |
| 2018/0112833 | A1 * | 4/2018 | Cao | F21V 3/02 |
| 2019/0017657 | A1 * | 1/2019 | Kim | F21K 9/232 |

* cited by examiner

*Primary Examiner* — Henry Luong

(74) *Attorney, Agent, or Firm* — Chun-Ming Shih; Lanway IPR Services

(57) ABSTRACT

A programmable light apparatus includes a LED module and a driver. The driver has a current adjustable circuit that supports multiple types of LED modules. By sending a programming signal to a wireless circuit of the driver, the current adjustable circuit determines a correct setting to provide a necessary driving current to a corresponding LED module.

14 Claims, 3 Drawing Sheets

PROGRAMMABLE LIGHT APPARATUS

FILED

The present invention is related to a programmable light apparatus and more related to a programmable light apparatus which configuration is adjustable after being manufactured.

BACKGROUND

There are various needs for light devices and thus there are various combination of LED modules to be installed on a light device. Different types of light devices may need different driving current parameters and thus it is difficult and not cost effective to design different drivers for different types of LED modules.

In eyes of the inventors of this invention, the inventors note that it would therefore be important to have a better design to provide an innovative solution to such problems.

SUMMARY OF INVENTION

According to a first embodiment of the present invention, a programmable light apparatus is provided. The programmable light apparatus may be a downlight device, a light bulb, a filament bulb with multiple LED (Light Emitted Diode) filaments or any other light devices.

The programmable light apparatus includes a LED module and a driver. During manufacturing, there are multiple predetermined settings for different programmable light apparatuses. For example, there are five types of such programmable light apparatuses like filament bulbs. Different filament bulbs have different numbers of LED filaments. Therefore, even each LED filament has the same parameter, different driving parameters are needed to successfully driving the different filament bulbs.

With the invention, these filament bulbs may be programmable even being manufactured while deploying the same driver. The driver is programmed with an external signal, e.g. an NFC (Near Field Communication) signal from an external device like a mobile phone, or a manufacturing tool in a factory, or even in a supermarket.

The driver has a wireless circuit for receiving a programming signal. The driver also has a processor circuit for converting the programming signal to a code. An execution circuit writes the code to a storage. The driver has a current adjustable circuit or other adjustable circuit like voltage adjustable circuit which is operated by reference to the code stored in the storage, e.g. a memory circuit. Thus, the same driver may be adapted for different needs for different types of LED modules actually being installed.

In some embodiments, even with the same LED modules, the programmable light apparatuses, e.g. downlight devices, may be configured with such methods in a shopping mall with a machine that is operated to generate the programming signal.

In such case, users may determine which color, or which color temperature to be used and the machine is operated to generate a corresponding programming signal to set the programmable light apparatus to emit lights of the desired color temperature or desired color.

Such approach is very helpful on stock management. Sellers only need to store the same programmable light apparatuses, and let customers determine what they need and configure the programmable light apparatuses directly with the methods mentioned above.

In some embodiments, the external device is a mobile phone sending an NFC signal as the programming command.

In some embodiments, the wireless circuit, the processor circuit and the execution circuit are operated with a signal electricity of the programming signal, even when the current adjustable circuit does not receive the external power source. In other words, by using magnet electricity to generate a minor electricity to drive the wireless circuit, the processor circuit and the execution circuit, even when the programmable light apparatus is not plugged to a power switch, the programmable light apparatus may still be configured to a desired setting by setting a corresponding programming signal as mentioned above.

In some embodiments, the programmable light apparatus also includes a battery for supplying power to the wireless circuit, the processor circuit and the execution circuit so that when the current adjustable circuit does not receive the external power source, the wireless circuit, the processor circuit and the execution circuit are still operable. The battery may be recharged when the light programmable apparatus is plugged to receive the external power source, like an alternating current from an indoor power source.

In some embodiments, the wireless signal is an NFC (Near Field Communication) signal. The wireless circuit comprises a coil for converting the programming signal to generate an electricity to drive the wireless circuit, the processor circuit and the execution circuit. The storage may be a memory circuit embedded with the wireless circuit, the processor circuit and the execution circuit.

In some embodiments, in the programmable light apparatus, the processor circuit has an amplifier for amplifying the programming signal.

In some embodiments, the code stored in the storage is sent to the current adjustable circuit to control an output current of the current adjustable circuit.

In some embodiments, the programmable light apparatus further has a PWM (Pulse Width Modulation) circuit retrieving the code in the storage to generate a corresponding PWM signal to adjust the current adjustable circuit.

In some embodiments, the processor circuit decodes the programming signal for determining whether the programming signal is an authentic signal. In some embodiments, to prevent dangerous operation, the storage is designed to be written for only once. Such design may be implemented by hardware breaking a path or software configuration.

In some embodiments, the programming signal is encrypted with a secret key to prevent unauthenticated operation to adjust the current adjustable circuit. The processor circuit uses an internal key to decrypt the programming signal to authenticate whether the programming signal is from an authenticated user or machine.

In some embodiments, the programmable light apparatus further has a dip switch for users to set a switch setting and the processor circuit references the switch setting in addition to the programming signal to determine the code. In other words, in addition to the code in the storage, other parameters may be set manually with a switch like a dip switch.

In some embodiments, different programmable light apparatuses have different LED modules but have the same driver. Such design makes it helpful on cost down because there is no need to provide various drivers just to match various LED modules.

In some embodiments, the driver is adjusted by changing the code generated according to the programming signal.

In some embodiments, the code has a default value for supporting a portion of the multiple predetermined settings.

In such case, most LED modules may use the default value while some other LED modules need to correspond to a different setting, which can be achieved by the programming method mentioned above.

In some embodiments, the LED module has multiple LED filaments, the programming signal is corresponding a number of the LED filaments. A LED filament is an elongated LED strip that has a solid or flexible substrate mounted with multiple LED chips. Such design may be used to produce LED filament bulbs.

In some embodiments, the programming signal indicates a desired color temperature parameter. In some embodiments, the programming signal indicates a desired color parameter. In other words, in addition to the current to be set, color temperatures or colors may also be indicated in the programming signal.

In some embodiments, the programming signal comprises an updated firmware code for the driver. This is particularly helpful in some IoT (smart) light devices. In addition, the updated firmware may guarantee future development possibility.

In some embodiments, the programmable light apparatus may further include a housing containing the LED module and the driver forming a downlight device.

DETAILED DESCRIPTION

According to a first embodiment of the present invention, a programmable light apparatus is provided. The programmable light apparatus may be a downlight device, a light bulb, a filament bulb with multiple LED (Light Emitted Diode) filaments or any other light devices.

Figure 1:
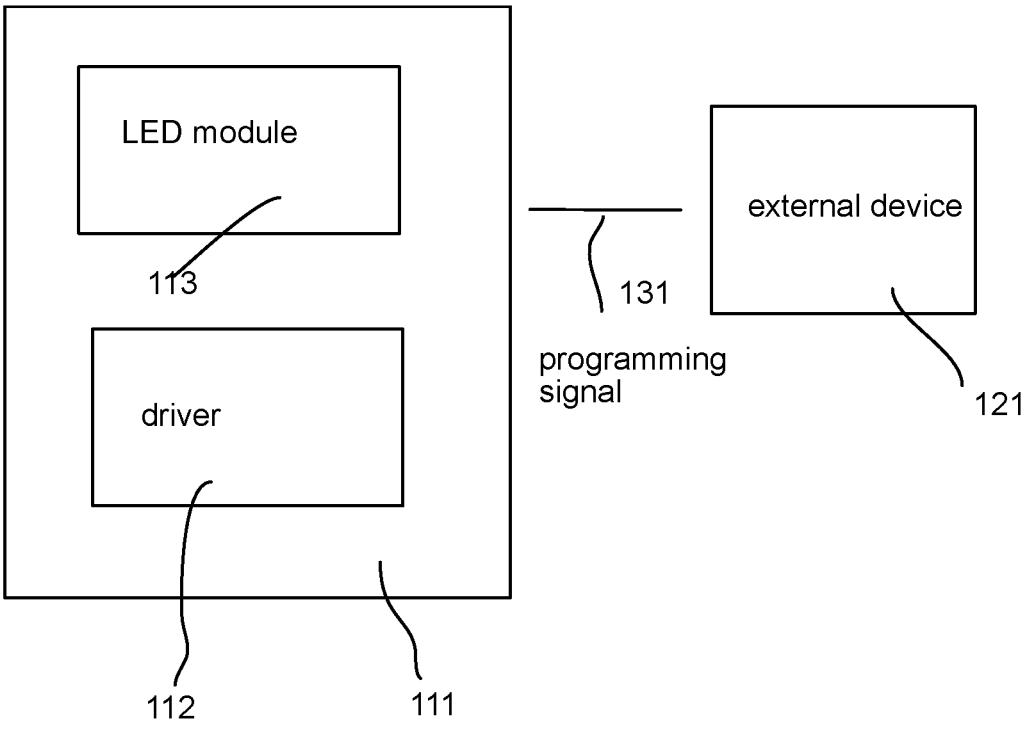
FIG. 1 is an embodiment of a programmable light apparatus.

Please refer to FIG. 1. FIG. 1 is an embodiment of a programmable light apparatus 111. The programmable light apparatus 111 includes a LED module 113 and a driver 112. There is an external device 121 generating a programming signal 131 to the programmable light apparatus 111 to change the behavior of the driver 112.

During manufacturing, there are multiple predetermined settings for different programmable light apparatuses. For example, there are five types of such programmable light apparatuses like filament bulbs. Different filament bulbs have different numbers of LED filaments. Therefore, even each LED filament has the same parameter, different driving parameters are needed to successfully driving the different filament bulbs.

With the invention, these filament bulbs may be programmable even being manufactured while deploying the same driver. The driver is programmed with an external signal, e.g. an NFC (Near Field Communication) signal from an external device like a mobile phone, or a manufacturing tool in a factory, or even in a supermarket.

Figure 2:
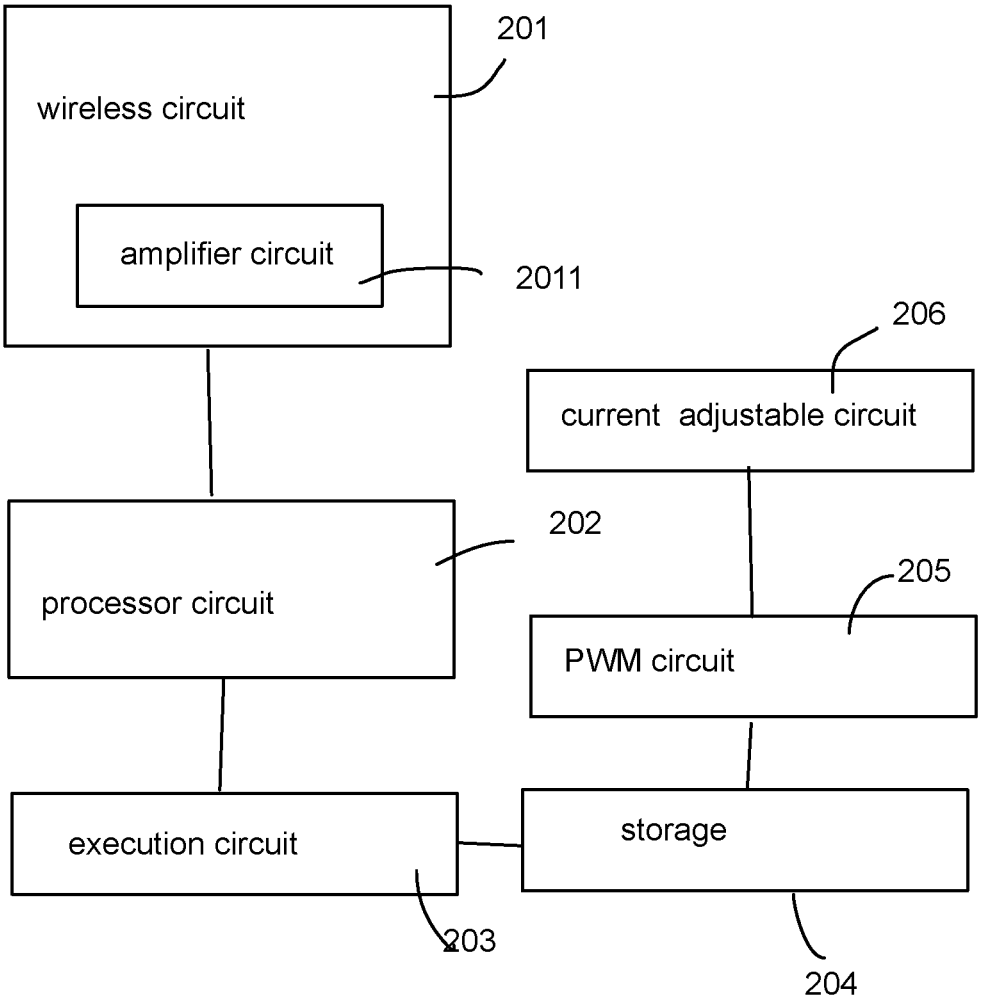
FIG. 2 illustrates an internal diagram of a driver in an embodiment.

Please refer to FIG. 2, which is an example of a driver design. The driver has a wireless circuit 201 for receiving a programming signal. To amplify the programming signal, the wireless circuit 201 may have an amplifying circuit 2011. The driver also has a processor circuit 202 for converting the programming signal to a code. An execution circuit 203 writes the code to a storage 204.

The driver has a current adjustable circuit 206 or other adjustable circuit like voltage adjustable circuit which is operated by reference to the code stored in the storage, e.g. a memory circuit. Thus, the same driver may be adapted for different needs for different types of LED modules actually being installed. The driver may also have a PWM circuit 205 for determining a PWM signal corresponding to the programming signal and the PWM signal is used by the current adjustable circuit to determine a final current output.

In some embodiments, even with the same LED modules, the programmable light apparatuses, e.g. downlight devices, may be configured with such methods in a shopping mall with a machine that is operated to generate the programming signal.

Figure 3A:
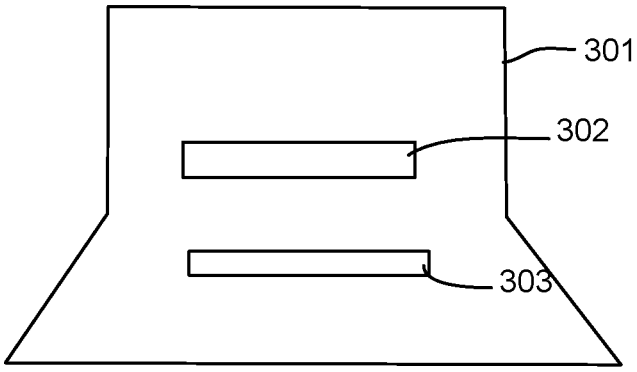
FIG. 3A illustrates a downlight example.

Please refer to FIG. 3A, which is an example of a downlight device. In FIG. 3A, a downlight housing 301 contains a LED module 303 and a driver 302.

Figure 3B:
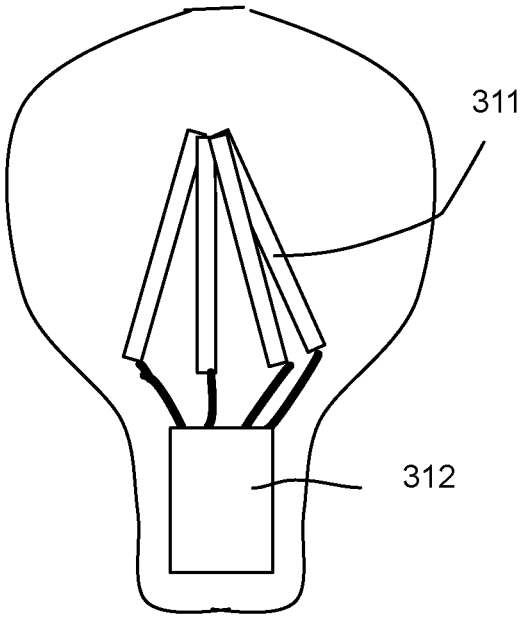
FIG. 3B illustrates a LED filament bulb example.

Please refer to FIG. 3B, which is

In such case, users may determine which color, or which color temperature to be used and the machine is operated to generate a corresponding programming signal to set the programmable light apparatus to emit lights of the desired color temperature or desired color.

Such approach is very helpful on stock management. Sellers only need to store the same programmable light apparatuses, and let customers determine what they need and configure the programmable light apparatuses directly with the methods mentioned above.

In some embodiments, the external device is a mobile phone sending an NFC signal as the programming command.

In some embodiments, the wireless circuit, the processor circuit and the execution circuit are operated with a signal electricity of the programming signal, even when the current adjustable circuit does not receive the external power source. In other words, by using magnet electricity to generate a minor electricity to drive the wireless circuit, the processor circuit and the execution circuit, even when the programmable light apparatus is not plugged to a power switch, the programmable light apparatus may still be configured to a desired setting by setting a corresponding programming signal as mentioned above.

In some embodiments, the programmable light apparatus also includes a battery for supplying power to the wireless circuit, the processor circuit and the execution circuit so that when the current adjustable circuit does not receive the external power source, the wireless circuit, the processor circuit and the execution circuit are still operable. The battery may be recharged when the light programmable apparatus is plugged to receive the external power source, like an alternating current from an indoor power source.

In some embodiments, the wireless signal is an NFC (Near Field Communication) signal. The wireless circuit comprises a coil for converting the programming signal to generate an electricity to drive the wireless circuit, the processor circuit and the execution circuit. The storage may be a memory circuit embedded with the wireless circuit, the processor circuit and the execution circuit.

Near field communication, abbreviated NFC, is a form of contactless communication between devices like smartphones or tablets. Contactless communication allows a user to wave the smartphone over a NFC compatible device to send information without needing to touch the devices together or go through multiple steps setting up a connection. Fast and convenient, NFC technology is popular in parts of Europe and Asia, and is quickly spreading throughout the United States.

Near field communication maintains interoperability between different wireless communication methods like Bluetooth and other NFC standards including FeliCa—popular in Japan—through the NFC Forum. Founded in 2004 by Sony, Nokia, and Philips, the forum enforces strict standards that manufacturers must meet when designing NFC compatible devices. This ensures that NFC is secure and remains easy-to-use with different versions of the technology. Compatibility is the key to the growth of NFC as a popular payment and data communication method. It must be able to communicate with other wireless technologies and be able to interact with different types of NFC transmissions.

The technology behind NFC allows a device, known as a reader, interrogator, or active device, to create a radio frequency current that communicates with another NFC compatible device or a small NFC tag holding the information the reader wants. Passive devices, such as the NFC tag in smart posters, store information and communicate with the reader but do not actively read other devices. Peer-to-peer communication through two active devices is also a possibility with NFC. This allows both devices to send and receive information.

Both businesses and individuals benefit from near field communication technology. By integrating credit cards, subway tickets, and paper coupons all into one device, a customer can board a train, pay for groceries, redeem coupons or store loyalty points, and even exchange contact information all with the wave of a smartphone. Faster transaction times mean less waiting in line and happier customers. Fewer physical cards to carry around means the customer is less likely to lose one or have it stolen.

The inventors note that NFC may be used for programming a driver in a light apparatus.

In some embodiments, in the programmable light apparatus, the processor circuit has an amplifier for amplifying the programming signal.

In some embodiments, the code stored in the storage is sent to the current adjustable circuit to control an output current of the current adjustable circuit.

In some embodiments, the programmable light apparatus further has a PWM (Pulse Width Modulation) circuit retrieving the code in the storage to generate a corresponding PWM signal to adjust the current adjustable circuit.

In some embodiments, the processor circuit decodes the programming signal for determining whether the programming signal is an authentic signal. In some embodiments, to prevent dangerous operation, the storage is designed to be written for only once. Such design may be implemented by hardware breaking a path or software configuration.

In some embodiments, the programming signal is encrypted with a secret key to prevent unauthenticated operation to adjust the current adjustable circuit. The processor circuit uses an internal key to decrypt the programming signal to authenticate whether the programming signal is from an authenticated user or machine.

In some embodiments, the programmable light apparatus further has a dip switch for users to set a switch setting and the processor circuit references the switch setting in addition to the programming signal to determine the code. In other words, in addition to the code in the storage, other parameters may be set manually with a switch like a dip switch.

In some embodiments, different programmable light apparatuses have different LED modules but have the same driver. Such design makes it helpful on cost down because there is no need to provide various drivers just to match various LED modules.

In some embodiments, the driver is adjusted by changing the code generated according to the programming signal.

In some embodiments, the code has a default value for supporting a portion of the multiple predetermined settings. In such case, most LED modules may use the default value while some other LED modules need to correspond to a different setting, which can be achieved by the programming method mentioned above.

In some embodiments, the LED module has multiple LED filaments, the programming signal is corresponding a number of the LED filaments. A LED filament is an elongated LED strip that has a solid or flexible substrate mounted with multiple LED chips. Such design may be used to produce LED filament bulbs.

Please refer to FIG. 3B, which shows an example of LED filament bulb. The LED filament bulb has a LED module 311 including multiple LED filaments and a driver 312.

In some embodiments, the programming signal indicates a desired color temperature parameter. In some embodiments, the programming signal indicates a desired color parameter. In other words, in addition to the current to be set, color temperatures or colors may also be indicated in the programming signal.

In some embodiments, the programming signal comprises an updated firmware code for the driver. This is particularly helpful in some IoT (smart) light devices. In addition, the updated firmware may guarantee future development possibility.

In some embodiments, the programmable light apparatus may further include a housing containing the LED module and the driver forming a downlight device. It is to be understood that the forms of the invention shown are preferred embodiments thereof and that various changes and modifications may be made therein without departing from the spirit of the invention or scope as defined in the following claims.

The invention claimed is:

1. A programmable light apparatus, comprising: a LED module, the LED module being configured to one of multiple predetermined settings, wherein the LED module comprises multiple LED filaments: and a driver designed for supporting all of the multiple predetermined settings, comprising: a current adjustable circuit tor converting an external power to a driving current to the LED module; a wireless circuit for receiving a programming signal to indicate a number of the multiple LED filaments from an external device; a processor circuit for converting the programming signal to a code; an execution circuit for writing the code to a storage, wherein the current adjustable circuit generates the driving current according to the code stored in the storage; and a switch for users to set a switch setting, wherein the processor circuit references the switch setting in addition to the programming signal to determine the code, the programming signal is corresponding the number of the multiple LED filaments for changing a parameter of the driver to correctly drive the multiple LED filaments.

2. The programmable light apparatus of claim 1, wherein the external device is a mobile phone sending an NFC signal as the programming command.

3. The programmable light apparatus of claim 1, wherein the wireless circuit, the processor circuit and the execution circuit are operated with a signal electricity of the programming signal, even when the current adjustable circuit does not receive the external power source.

4. The programmable light apparatus of claim 1, further comprising a battery for supplying power to the wireless circuit, the processor circuit and the execution circuit so that when the current adjustable circuit does not receive the external power source, the wireless circuit, the processor circuit and the execution circuit are still operable.

5. The programmable light apparatus of claim 1, wherein the wireless signal is an NFC (Near Field Communication) signal.

6. The programmable light apparatus of claim 1, wherein the processor circuit comprises an amplifier for amplifying the programming signal.

7. The programmable light apparatus of claim 1, wherein the code stored in the storage is sent to the current adjustable circuit to control an output current of the current adjustable circuit.

8. The programmable light apparatus of claim 1, further comprising a PWM (Pulse Width Modulation) circuit retrieving the code in the storage to generate a corresponding PWM signal to adjust the current adjustable circuit.

9. The programmable light apparatus of claim 1, wherein the processor circuit decodes the programming signal for determining whether the programming signal is an authentic signal.

10. The programmable light apparatus of claim 9, wherein the programming signal is encrypted with a secret key to prevent unauthenticated operation to adjust the current adjustable circuit.

11. The programmable light apparatus of claim 1, wherein the programming signal indicates a desired color temperature parameter.

12. The programmable light apparatus of claim 1, wherein the programming signal indicates a desired color parameter.

13. The programmable light apparatus of claim 1, wherein the programming signal comprises an updated firmware code for the driver.

14. The programmable light apparatus of claim 1, further comprising a housing containing the LED module and the driver forming a downlight device.

* * * * *